US005160202A

United States Patent [19]

Légaré

[11] Patent Number: 5,160,202

[45] Date of Patent: Nov. 3, 1992

[54] ILLUMINATED CONCRETE CURBSTONE

[76] Inventor: Luc R. Légaré, 4220, Parnier, Pierrefonds, Quebec, Canada, H9K 1K8

[21] Appl. No.: 818,336

[22] Filed: Jan. 9, 1992

[51] Int. Cl.[5] ..... E01F 9/00

[52] U.S. Cl. ..... 362/153.1; 362/145

[58] Field of Search ..... 362/145, 152, 153, 153.1, 362/234, 253

[56] References Cited

U.S. PATENT DOCUMENTS 1,648,459 11/1927 Mendoza ..... 362/152 X 2,920,184 1/1960 Kessler ..... 362/152

3,495,352 2/1970 Sbare ..... 362/152 X 3,663,808 5/1972 Baatz ..... 362/152

*Primary Examiner*—Stephen F. Husar

*Attorney, Agent, or Firm*—Roland L. Morneau

[57] ABSTRACT

A concrete curbstone block is provided with an internal illuminated housing for projecting light onto a driveway. The housing has a transparent window receeding from the flat front face of concrete. A downwardly and rearwardly channel extends from the housing for the electrical wires, for allowing air circulation and for eliminating the condensation.

7 Claims, 3 Drawing Sheets

ILLUMINATED CONCRETE CURBSTONE

BACKGROUND OF THE INVENTION

1. Field of the Invention

The invention relates to concrete blocks for forming a curbstone adapted to be partly immersed in the ground adjacent a driveway. The blocks are particularly characterized by an illuminated housing inside the portion of the blocks adapted to lie above the ground.

2. Prior Art

U.S. Pat. No. 2,920,184 is directed to an illuminated driveway curbing consisting of an inverted V-shaped cover made of transparent plastic adapted to house illuminating means. The cover projects light upwardly over a complete 180 degree angle and is bolted on the surface of a flat driveway.

The illuminated safety curbing described in U.S. Pat. No. 3,663,808 includes a plastic cover mounted on a rigid base structure which is adapted to be bolted above a flat surface.

Canadian patent No. 307,360 describes a traffic signal consisting in a recess in a sidewalk at a street intersection. Illuminating means are provided to project light on colored lenses closing the recess.

In the prior patents, none was found which describes a self-contained concrete block adapted to be partly immersed in the ground wherein the block is provided with an illuminated housing above the ground for projecting light towards an adjacent driveway. The fact that the housing is built in a concrete block and that the lighting means must be replaced is taken into consideration. A channel is foreseen for allowing air circulation. The channel is directed downwardly for eliminating the product of any condensation. The same channel is also used for the passage of electrical wires and its exit is located above the ground for maintaining the air circulation.

SUMMARY OF THE INVENTION

The present invention relates to an illuminated concrete curbstone block for driveway curbing which is adapted to be partly immersed in the ground adjacent the driveway.

The prismatic concrete block has a top face, a rear face, a front face and two lateral faces. A portion of the rear, front and lateral faces emerges above the ground. A housing is located inside the block adjacent the top face. The housing forms a transparent rigid window substantially aligned with the front face a preferably receding therefrom. The window is adapted to lie at the level above the ground.

A lighting means is provided in the housing including a reflector for projecting the light from the lighting means through the window. The lighting means is fed by electrical wires coming from outside the block.

An open channel extends downwardly from the housing to the rear face for allowing the wires to freely pass therethrough and for letting the wires extend outside the block at a level above the ground. The open channel also allows air circulation therethrough.

The illuminated curbstone is adapted to project light onto to the driveway at a level above the ground and the channel is adapted to allow air penetration into the housing.

The lateral faces of the curbstone are provided with a vertical rib and a vertical corresponding groove. The rib is adapted to fit into the groove of an adjacent curbstone for preventing edgewise displacement of two adjacent curbstones. In a specific embodiment of the invention, the curbstone has a dome-shaped portion located over the housing. In the preferred embodiment, a reflector is located inside the housing for projecting the light of the lighting means in the direction of the window.

DETAILED DESCRIPTION OF THE PREFERRED EMBODIMENT

Figure 1:
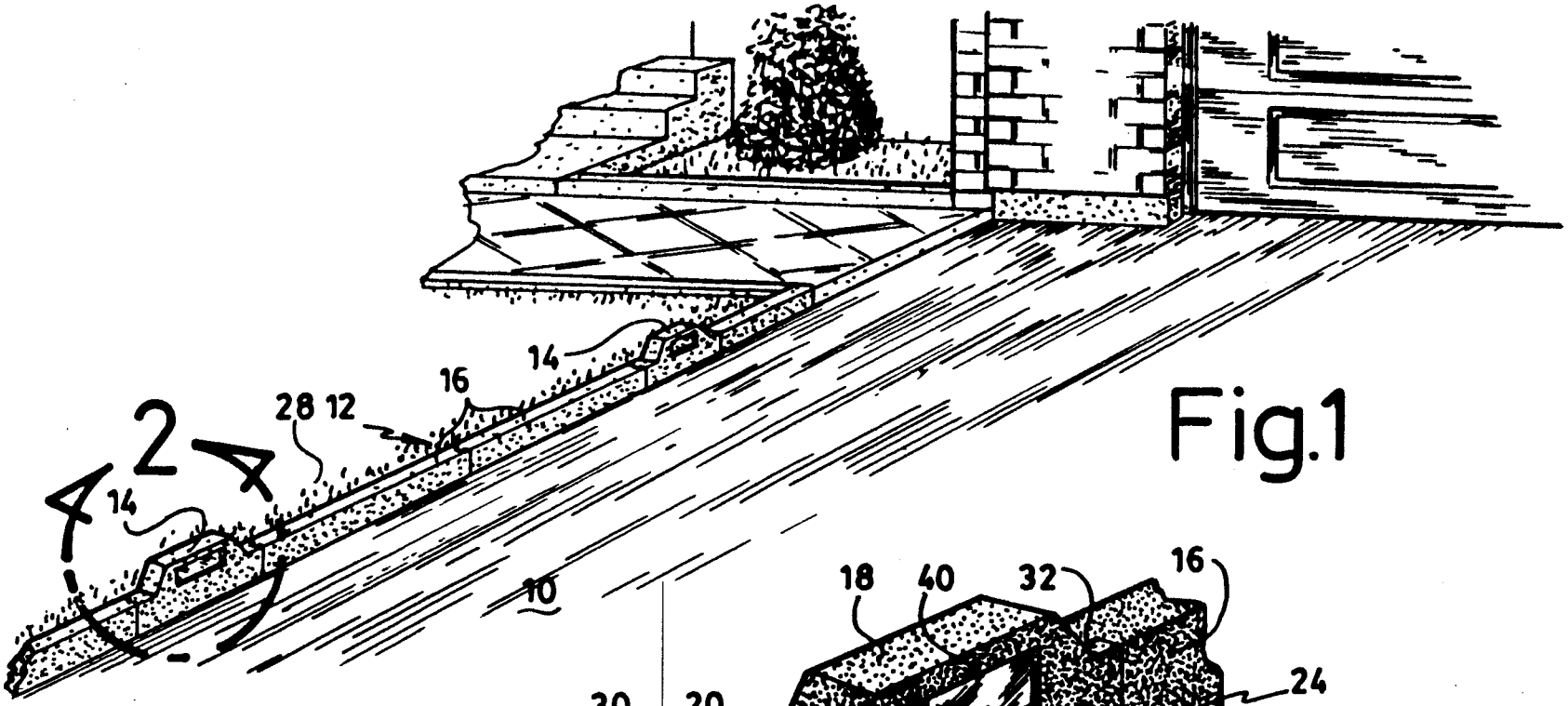
FIG. 1 is a partial view of a driveway curbing having a set of illuminated concrete blocks embodying the invention.

Referring to FIG. 1 there is shown a driveway 10 having a driveway curbing 12. The curbing 12 has a set of illuminated concrete curbing blocks 14 embodying the invention. The illuminated blocks 14 are spaced apart by conventional concrete curb stone blocks 16.

Figure 2:
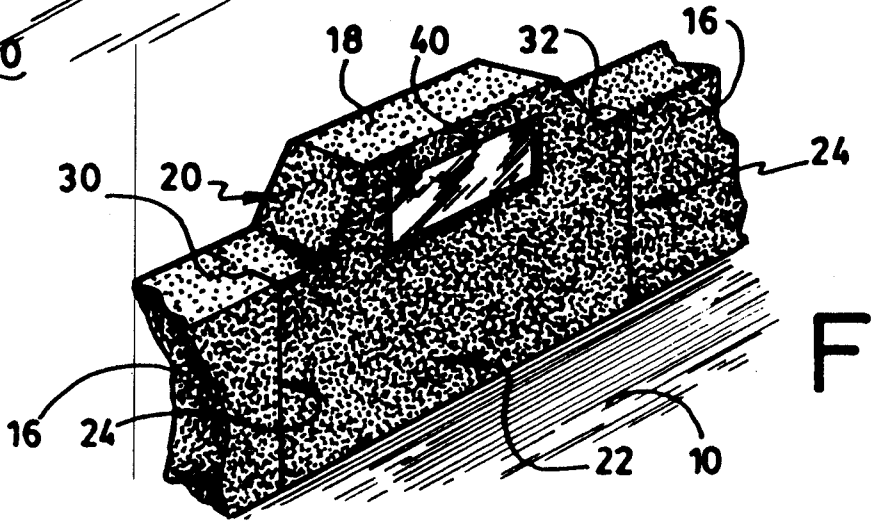
FIG. 2 is a perspective view taken inside arrow 2 of FIG. 1 of an illuminated concrete block embodying the invention.
Figure 3:
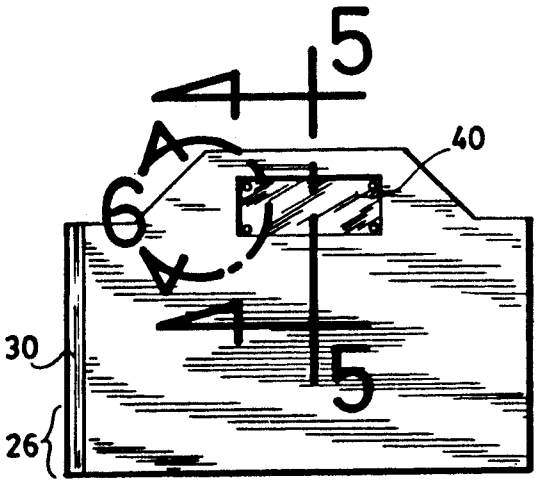
FIG. 3 is a front view of an illuminated concrete block.
Figure 4:
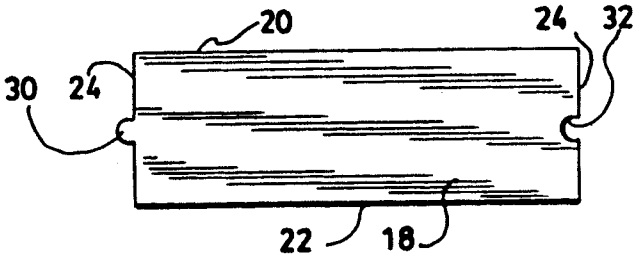
FIG. 4 is a bottom view of an illuminated concrete block.
Figure 6:
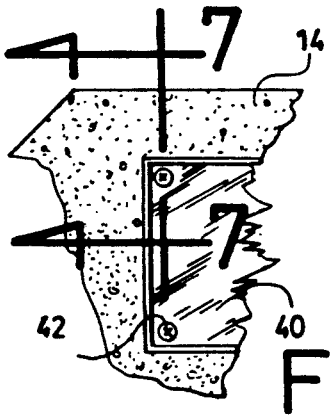
FIG. 6 is a detailed frontal view of the front section of the top portion of an illuminated concrete block taken inside arrow 6 of FIG. 3.

FIG. 2 illustrates the external appearance of an illuminated concrete block 14. The block 14 has a top face 18, a rear face 20, a front face 22 and two lateral faces 24. As can be seen, a portion of the rear face 20, the front face 22, and the lateral faces 24 emerges above the surface of the driveway 10. Another portion indicated by the reference numeral 26 in FIG. 3 is immersed underneath the surface of the driveway 10 by a distance sufficient to upstandingly hold 14 in the ground.

The block 14 is thus secured in place by its immersed portion 26. The block 14 is often further stabilized by soil or other similar material which rises above the level of the driveway 10 and abuts against the rear face 20 as exemplified with the soil 28 of FIG. 1.

The block 14 is linked to adjacent curbstone blocks 16 by a vertical rib 30 and a corresponding vertical groove 32 provided on its opposite lateral faces 24. The rib 30 and the groove 32 are adapted to fit into a set of corresponding rib and groove of the adjacent blocks 16 to prevent edgewise displacement of two adjacent curbstones.

Figure 5:
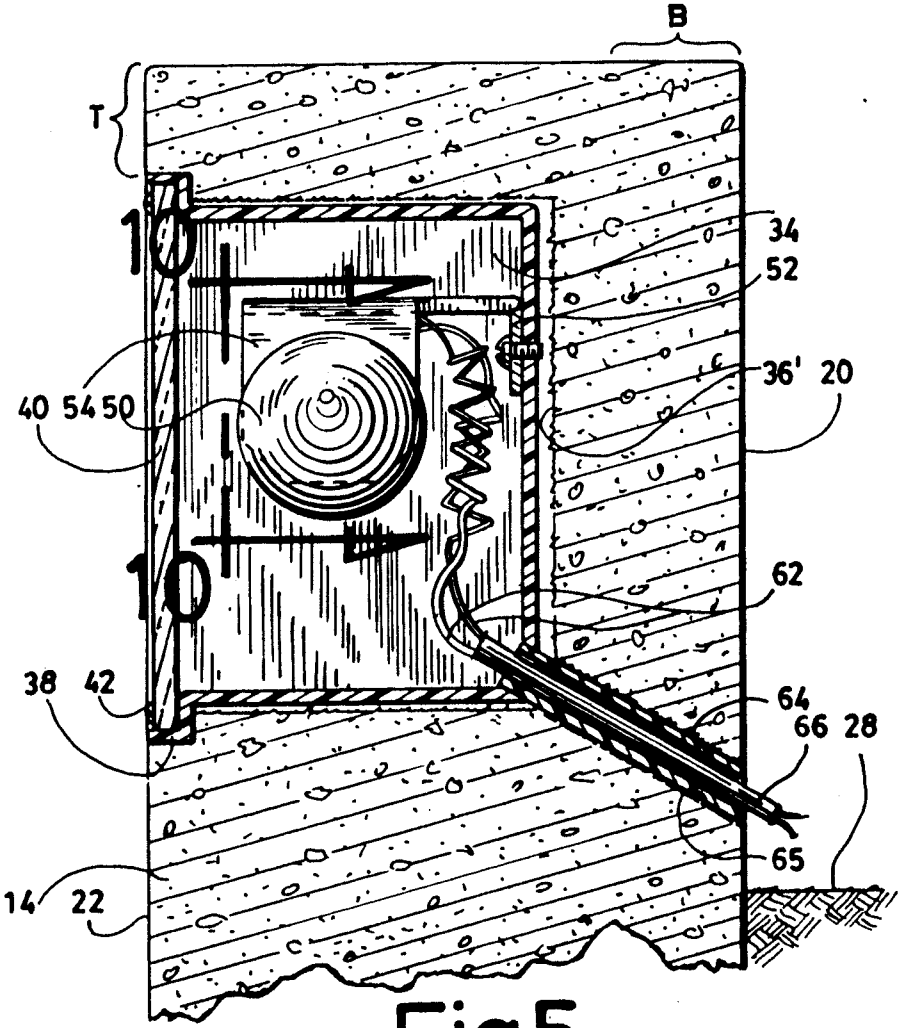
FIG. 5 is a cross-sectional view of the top portion of a concrete block taken along arrows 5—5 of FIG. 3.

As can be seen in the cross-section of FIG. 5, the block 14 has an internal housing 34 positioned inside a corresponding recess 36. The recess 36 which extends from the front face 22 is located adjacent the top face 18. The housing 34 has a substantially L-shaped peripheral flange 38 adapted to abuttingly support a frontal window 40.

Figure 7:
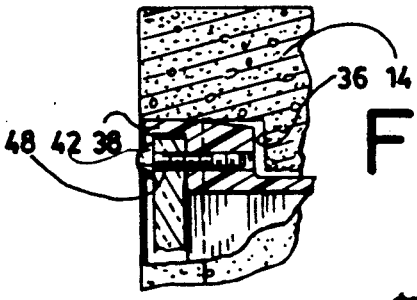
FIG. 7 is a cross-sectional view taken along arrows 7—7 of FIG. 6 illustrating the link between the front window and the inner housing.
Figure 8:
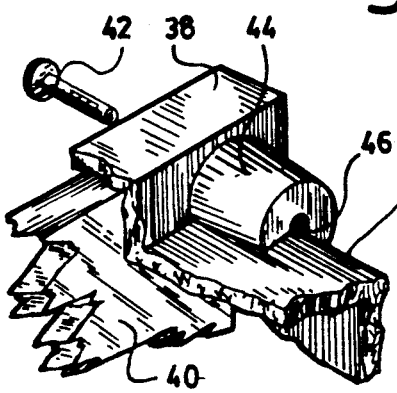
FIG. 8 is a detailed perspective view of a corner portion of the block illustrating a method of fixing the front window to the inner housing.

As illustrated in FIGS. 7 and 8, the window 40 is removably fixed to the housing 34 by a set of screws 42. A set of corresponding fixative protuberances 44 each having a threaded channel 46 extend integrally and inwardly from the flange 38. Each screw 42 is adapted to extend through an aperture 48 provided in the window 40 and to threadedly engage the corresponding threaded channel 46, thus removably fixing the window 40 to the housing 34.

The housing 34 is preferably made of polymeric material and manufactured through an injection process. The preferred embodiment thus illustrates a set of fixative protuberances 44 having the shape of a longitudinally truncated inwardly tapering cone which is also interrupted at approximately $\frac{3}{4}$ of its radius to merge integrally into the walls of the housing 34. The specific shape of the protuberances 44 facilitates the molding process specifically during the retraction phase and minimizes the amount of material used thus optimizing the manufacturing costs.

Figure 9:
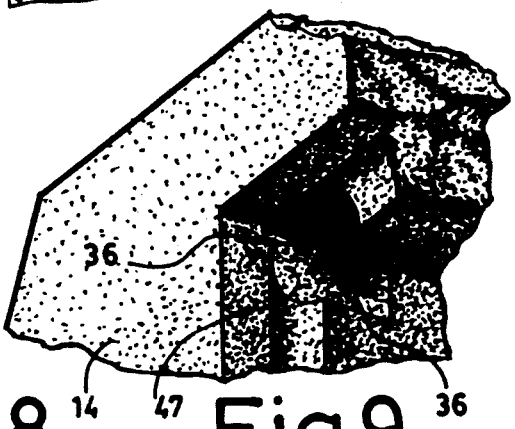
FIG. 9 is a detailed view of the corner portion of the concrete block adapted to receive the corresponding corner portion of the inner housing illustrated in FIG. 8.

As illustrated in FIG. 9, the recess 36 in the concrete block 14 is provided with a set of corresponding cavities adapted to fittingly receive the fixative protuberances 44.

Figure 10:
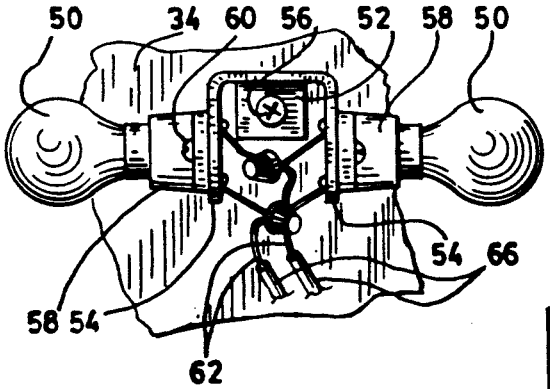
FIG. 10 is a detailed view of the lighting bulb arrangement.

As illustrated in FIGS. 5 and 10, the housing 34 protectively encloses a lighting source. In the preferred embodiment, the lighting source takes the form of a pair of light bulbs 50 mounted on a bracket. The bracket has a substantially L-shaped fixative tongue 52 extending integrally into a substantially U-shaped perpendicular mounting tongue having substantially vertical walls 54. The fixative tongue 52 is fixed to the back portion of the housing 34 by a screw 56. Each one of the walls 54 is adapted to support a conventional light bulb socket 58. The sockets 58 are fixed to the walls 54 by a set of screws 60. As illustrated in FIG. 10, the sockets 58 are positioned so that the light bulb face away from each other on a plane parallel to the window 40.

Electrical current is brought to the sockets 58 by a set of conventional electrical wires 62. As illustrated in FIG. 5, a channel 64 extends rearwardly and downwardly from the housing 34 to the rear face 20 of the block 14. The channel 64 which consists of a substantially cylindrical passageway allows the wire 62 to freely pass therethrough and to extend outside of the block 14 above the soil 28. The wire 62 can thus easily be connected to a power source which is preferably of a low voltage.

The channel 64 also allows for air circulation inside the housing 34 allowing the air inside the housing 34 to cool down. The downward slant of the channel 64 further enables it to serve as a drain to eliminate condensation which might build up inside the housing 34. A set of sleeves 66 is provided around the wires 62 to minimize the friction with the channel 64 and to further insulate the wire 62 against humidity.

In order to further increase the efficiency of the lighting source by projecting the light towards the window 40, the interior surface of the housing 34 is coated with a reflective material.

As illustrated in FIG. 5, the recess 36 is positioned inside the block 14 and defines a top wall referred by the letter T and a back wall referred to by the letter B. In order to insure structural rigidity of the block 14, the walls T and B have a minimal thickness of about one inch.

Figure 11:
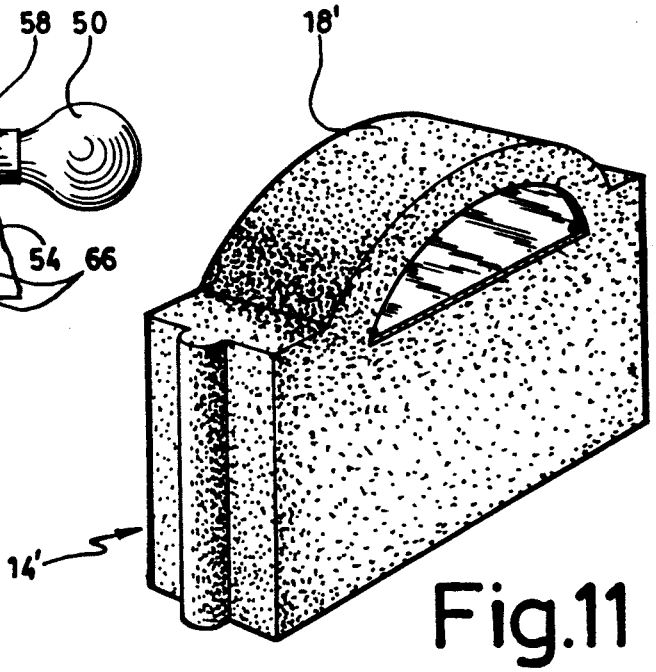
FIG. 11 is a perspective view of an alternative embodiment of the lighting block having an arcuate top portion.

The blocks 14 are adapted to be manufactured in a variety of sizes and prismatic shapes. FIG. 11 illustrates an alternative embodiment of the invention wherein the block 14' has a substantially arcuate shape 18'.

I claim:

1. An illuminated concrete curbstone block for driveway curbing adapted to be partly immersed in the ground adjacent a driveway, said block comprising a prismatic concrete block having a top face, a rear face, a front face and two lateral faces, a portion of said rear, front and lateral faces adapted to emerge above the ground, a housing located inside said block adjacent said top face, said housing forming a transparent rigid window substantially aligned with said front face, said window adapted to lie at a level above the ground, a lighting means in said housing and a reflector for projecting the light from said lighting means through said window, said means having electric wires for electrically feeding said lighting means, an open channel downwardly extending from said housing to said rear face for allowing said wires to freely pass therethrough and for letting said wires extend outside said block at a level above the ground and for allowing air circulation therethrough, whereby said illuminated curbstone block is adapted to project light onto said driveway at the level above the ground and said channel is adapted to allow air penetration into said housing.

2. An illuminated concrete curbstone block as recited in claim 1, wherein said two lateral faces of the curbstone block are respectively provided with a vertical rib and a vertical corresponding groove, wherein said rib is adapted to fit into the groove of an adjacent curbstone block for preventing edgewise displacement of two adjacent curbstone blocks.

3. An illuminated concrete curbstone block as recited in claim 2, wherein said curbstone has an arch-shaped portion located over said housing.

4. An illuminated concrete curbstone block as recited in claim 3, comprising a reflector located inside said housing for projecting the light of said lighting means in the direction of said window.

5. An illuminated concrete curbstone block as recited in claim 4, wherein said front face of the curbstone block is substantially straight and said window recede inside said front face.

6. An illuminated concrete curbstone block as recited in claim 5, wherein said housing is located inside said curbstone block to define a top and a rear wall having a minimum thickness of about one inch.

7. An illuminated concrete curbstone block as recited in claim 6, wherein said lighting means comprises two light bulbs each having a socket oriented parallel to said front face.

* * * * *